US006207359B1

(12) United States Patent
Farid et al.

(10) Patent No.: US 6,207,359 B1
(45) Date of Patent: Mar. 27, 2001

(54) METHOD FOR REDUCING THE DYE STAIN IN PHOTOGRAPHIC ELEMENTS

(75) Inventors: Samir Y. Farid, Rochester; Ramanuj Goswami, Webster; Mary E. Craver; John M. Mangus, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/510,012

(22) Filed: Feb. 22, 2000

(51) Int. Cl.[7] ..... G03C 1/40
(52) U.S. Cl. ..... 430/390; 430/462
(58) Field of Search ..... 430/390, 462

(56) References Cited

U.S. PATENT DOCUMENTS

| | | | |
|---|---|---|---|
| 3,615,432 | 10/1971 | Jenkins et al. . | |
| 3,745,009 | 7/1973 | Jenkins et al. . | |
| 4,548,896 | 10/1985 | Sabongi et al. | 430/332 |
| 4,581,323 | 4/1986 | Fisher et al. | 430/513 |
| 4,701,402 | 10/1987 | Patel et al. | 430/332 |
| 4,743,528 | 5/1988 | Farid et al. | 430/281 |
| 4,743,529 | 5/1988 | Farid et al. | 430/281 |
| 4,743,530 | 5/1988 | Farid et al. | 430/281 |
| 4,743,531 | 5/1988 | Farid et al. | 430/281 |
| 4,769,459 | 9/1988 | Patel et al. | 430/301 |
| 4,875,080 | 10/1989 | Kimura et al. | 430/103 |
| 5,312,721 | 5/1994 | Gesing | 430/449 |

FOREIGN PATENT DOCUMENTS

| | | |
|---|---|---|
| 0 308 274 | 8/1994 | (EP) . |
| WO 93/04411 | 3/1993 | (WO) . |

*Primary Examiner*—Hoa Van Le
(74) *Attorney, Agent, or Firm*—Edith A. Rice

(57) ABSTRACT

A method for reducing dye stain of an exposed photographic element, said element comprising a support having thereon at least one image-forming layer containing a photobleachable dye, the method comprising processing the element, and exposing the processed element, in presence of a N-oxyazinium, to radiation that can be absorbed either by the photobleachable dye or by the N-oxyazinium.

10 Claims, No Drawings

METHOD FOR REDUCING THE DYE STAIN IN PHOTOGRAPHIC ELEMENTS

FIELD OF THE INVENTION

The invention relates to a method for reducing dye stain in photographic elements. It also relates to a photographic element containing a photobleachable compound.

BACKGROUND OF THE INVENTION

Sensitizing dyes are added to photographic emulsions in order to impart spectral sensitivity beyond the intrinsic absorption range of silver halide. Sensitizing dyes are compounds that absorb light at wavelengths ranging from the near UV (ca. 400 nm) to the infrared (ca. 850 nm). Light that is absorbed by said sensitizing dyes results in electron injection into the conduction band of the silver halide, and ultimately in the formation of a latent image. In this way, the spectral response of photographic emulsions is extended to the spectral region covered by the absorption of the dye.

When used to impart spectral sensitivity to a photographic silver halide grains, the sensitizing dyes are usually removed during the processing steps (developing, fixing, and washing). The current trend is towards decreasing these processing times, since this has the advantage of reducing the amount of effluents. However, removal of the sensitizing dyes is often less efficient with shorter processing times. Residual sensitizing dyes, which remain in the emulsions after processing, cause unwanted coloration (dye stain) of the photographic material. In addition, some sensitizing dyes have a high propensity towards aggregation and/or have poor water solubility and as a result would require excessive processing times for complete removal.

SUMMARY OF THE INVENTION

It is desirable to find a method for reducing dye stain of an exposed and processed photographic material without affecting the image dye.

This objective is achieved by the present invention which provides a method for reducing dye stain of an exposed photographic element, said element comprising a support having thereon at least one image-forming layer containing a photobleachable dye, the method comprising processing the element, and exposing the processed element, in presence of a N-oxyazinium, to radiation that can be absorbed either by the photobleachable dye or by the N-oxyazinium.

The method involves photochemically bleaching the dyes by photoreactions of the dyes with N-oxyazinium compounds.

This invention provides a photobleaching method that can be advantageously carried out for a wide variety of photobleachable sensitizing dyes.

DETAILED DESCRIPTION OF THE INVENTION

When reference in this application is made to a particular group, unless otherwise specifically stated, the group may itself be unsubstituted or substituted with one or more substituents (up to the maximum possible number). For example, "alkyl" group refers to a substituted or unsubstituted alkyl group, while "aryl" refers to a substituted or unsubstituted aryl (with up to six substituents). The substituent may be itself substituted or unsubstituted.

Generally, unless otherwise specifically stated, substituents include any substituents, whether substituted or unsubstituted, which do not destroy properties necessary for the photographic utility. Examples of substituents include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

In the scope of the invention, the N-oxyazinium compound is an N-oxy-N-heterocyclic compound having from 5 to 14 nuclear carbon atoms in the heterocycle such as a pyridinium, diazinium, or triazinium nucleus. The N-oxyazinium compound can include one or more aromatic rings, typically carbocyclic aromatic rings, fused with the N-oxy-N-heterocyclic compound, including quinolinium, isoquinolinium, benzodiazinium, and naphthodiazinium. Any convenient charge balancing counter-ion can be employed to complete the N-oxyazinium compounds. The oxy group (—O—$R_1$) of the N-oxyazinium compound which quaternizes the ring nitrogen atom of the azinium nucleus can be selected from among a variety of synthetically convenient oxy groups. The group $R_1$ can, for example, be an alkyl group such as methyl, ethyl, butyl, benzyl, an aralkyl group (e.g., benzyl or phenethyl) and a sulfoalkyl group (e.g., sulfomethyl). The group $R_1$ can be an aryl group such as a phenyl group. In another form $R_1$ can be an acyl group, such as an —C(O)—$R_3$ group, where $R_3$ is an alkyl and aryl groups such as phenyl or naphthyl, tolyl, xylyl, etc. When $R_1$ is an alkyl group, it typically contains from 1 to 18 carbon atoms, when $R_1$ is an aryl group, it typically contains from 6 to 18 carbon atoms.

Illustrative examples of useful N-oxyazinium compounds are shown by the formulae below:

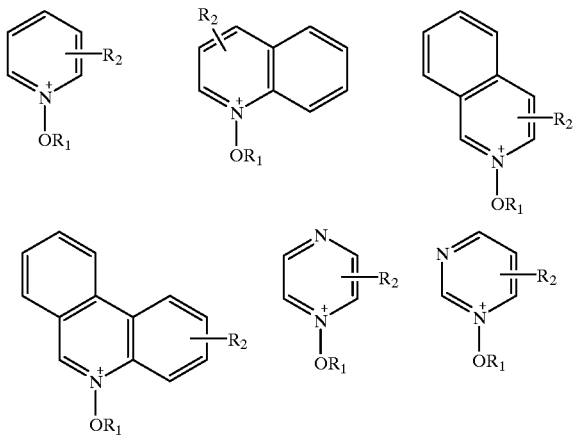

-continued

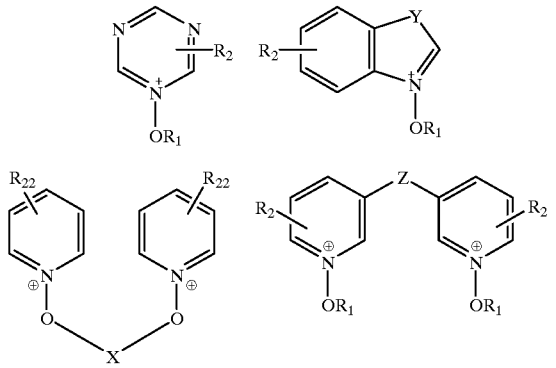

wherein $R_1$ represents alkyl group of 1–12 carbons, or alkyl group substituted with one or more groups selected from the group consisting of acyloxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, carboxy, sulfo, trihalomethyl, alkyl, aryl, heteroaryl, alkylureido, arylureido, succinimido, and phthalimido substituent; aryl group, or acyl group; $R_2$, $R_{22}$ or $R_6$ represents independently hydrogen, an alkyl group of 1–12 carbons, an aryl or heteroaryl group, unsubstituted or substituted with one or more substituents selected from the group consisting of an acyloxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, carboxy, sulfo, trihalomethyl, alkyl, aryl, heteroaryl, alkylureido, arylureido, succinimido and phthalimido substituent, or an acyloxy, hydroxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, amino, alkylamino, arylamino, carboxy, sulfo, trihalomethyl, alkyl, aryl, heteroaryl, alkylureido, arylureido, succinimido, phthalimido group, —CO—$R_3$ wherein $R_3$ is an alkyl or an aryl group, or —(CH=CH)$_m$—$R_4$ wherein $R_4$ is an aryl or heterocyclic group; m is 1 or 2 ; Y is selected from the group consisting of S, O, Se, —C($R_1$)$_2$, and —N$R_1$; X is a divalent linking group selected from a group consisting of substituted or unsubstituted methylenes, (—C$R_5R_7$—)$_n$ and [(—C$R_5R_7$)$_n$—$X_1$—(C$R_5R_7$—)$_P$] wherein $R_5$ or $R_7$ are independently hydrogen, alkyl, substituted alkyl, aryl, substituted aryl, heteroaryl, substituted heteroaryl group, n and p are from 1–12, $X_1$ is aryl or heteroaryl nuclei, carbonyl, sulfo, thio, oxy; and Z is an alkylidene group.

In the scope of the invention, each of the above formulae can comprise one or more $R_2$, $R_{22}$ or $R_6$ group.

Useful N-oxyazinium compounds can also be represented by the following formula

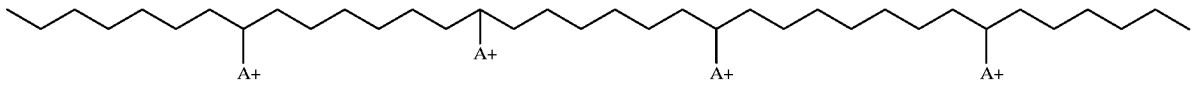

-continued

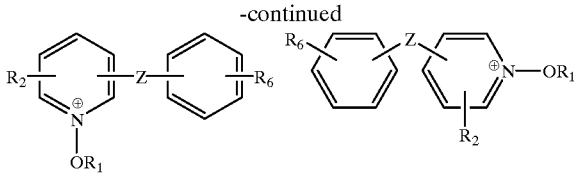

wherein $A^+$ is the N-oxyazinium moiety. The linking alkyl chain can have additional substituents, e.g., ether, ester, amide, etc.

According to one embodiment, the N-oxyazinium compound is a compound having one of the following formulae:

(II)

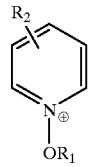

(III)

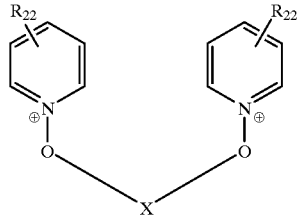

wherein $R_1$ is an alkyl, an aryl or an acyl, $R_2$ or $R_{22}$ are independently an hydrogen atom, alkyl, aryl, heterocyclic, carboxylic, carboxylate, carbonamido, sulfonamido, nitryl, groups, —CO—$R_3$ wherein $R_3$ is an alkyl group or aryl group, or (—CH=CH)$_m$—$R_4$ group wherein $R_4$ is an aryl or heterocyclic group; X is an alkylene group, preferably —(CH$_2$)$_n$— wherein n is from 1 to 12.

According to a specific embodiment, $R_1$ is preferably an alkyl having from 1 to 18 carbon atoms or an aryl group having from 6 to 18 carbon atoms.

Illustrative examples of N-oxyazinium compounds useful in the present invention are one of the following compounds:

| | (II) $R_2$ or $R_{22}$ | (III) $R_1$ or X |
|---|---|---|
| A-1 | $R_2$ = 4-Ph | $R_1$ = Me |
| A-2 | $R_2$ = 4-Ph | $R_1$ = $(CH_2)_3$—Ph |
| A-3 | $R_2$ = 4-Ph | $R_1$ = $(CH_2)_3$—$SO_3^-$ |
| A-4 | $R_2$ = 4-Ph | $R_1$ = |
| A-5 | $R_2$ = 4-Ph | $R_1$ = |
| A-6 | $R_2$ = 4-CN | $R_1$ = Me |
| A-7 | $R_2$ = 3-$CO_2$Me | $R_1$ = Me |
| A-8 | $R_2$ = 3-$CO_2$—$(CH_2)_2$—Ph | $R_1$ = Me |
| A-9 | $R_{22}$ = 4-Ph | X = $(CH_2)_3$ |
| A-10 | $R_{22}$ = 4-Ph | X = $(CH_2)_4$ |
| A-11 | $R_{22}$ = 4-Ph | X = $(CH_2)_5$ |
| A-12 | $R_2$ = 3-Ph | $R_1$ = Me |
| A-13 | $R_2$ = 3,4-benzo | $R_1$ = Me |
| A-14 | $R_{22}$ = 3,4-benzo | X = $(CH_2)_3$ |
| A-15 | $R_2$ = H | $R_1$ = $(CH_2)_3$—$SO_3^-$ |
| A-16 | $R_2$ = H | $R_1$ = 4-nitrophenyl |
| A-17 | $R_{22}$ = H | X = $(CH_2)_2$ |
| A-18 | $R_{22}$ = H | X = $(CH_2)_3$ |
| A-19 | $R_2$ = 2-Me | $R_1$ = Me |
| A-20 | $R_2$ = 2-Me | $R_1$ = $(CH_2)_3$—$SO_3^-$ |
| A-21 | $R_2$ = 4-Me | $R_1$ = Me |
| A-22 | $R_{22}$ = 4-Me | X = $(CH_2)_4$ |
| A-23 | $R_2$ = 4-$CO_2^-$ | $R_1$ = Me |
| A-24 | $R_2$ = 4-$CON(CH_2CH_2OH)_2$ | $R_1$ = $(CH_2)_3$—$SO_3^-$ |

According to the present invention, the N-oxyazinium compound has a reduction potential less negative than −1.4 V, and comprises an N-oxy group capable of releasing an oxy radical that reacts with the photobleachable dye to produce bleached compound.

In the present invention, the photographic element can be contacted with one or more of any of the N-oxyazinium compounds disclosed therein.

The N-oxyazinium compounds are associated with a counter ion that is not involved in the activity of the present composition and can be any of the conventional anions, e.g., halide, fluoroborate, toluene sulfonate, etc. It can also be an oligomeric or polymeric species.

In the scope of the invention, the photobleachable dye is any dyes that by reaction with an N-oxyazinium compound give a bleached compound. According to the invention, a bleached compound is a colorless compound or a compound less colored than the dye.

The photobleachable dye can be cyanine dyes, complex cyanine dyes, merocyanine dyes, complex merocyanine dyes, homopolar cyanine dyes, styryl dyes, oxonol dyes, hemioxonol dyes, and hemicyanine dyes. Representative spectral sensitizing dyes are discussed are discussed in *Research Disclosure*, Item 36544, September 1996, the disclosure of which, including the disclosure of references cited therein are incorporated herein by reference. These dyes may be synthesized by those skilled in the art according to the procedures described herein or F. M. Hamer, *The Cyanine Dyes and Related Compounds* (Interscience Publishers, New York, 1964). Photobleachable spectral sensitizing dyes can be cyanine or merocyanine dyes represented by the general formulae D1–D5 below:

D1

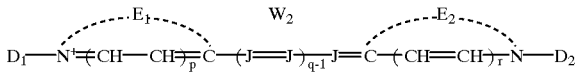

wherein:

$E_1$ and $E_2$ represent the atoms necessary to form a substituted or unsubstituted hetero ring and may be the same or different, each J independently represents a methine group, q is a positive integer of from 1 to 4, p and r each independently represents 0 or 1, $D_1$ and $D_2$ each independently represents alkyl or aryl groups, and $W_2$ is a counter ion as necessary to balance the charge;

D2

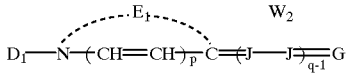

wherein $E_1$, $D_1$, J, p, q and $W_2$ are as defined above for formula D1 and G represents

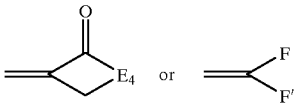

wherein $E_4$ represents the atoms necessary to complete a heterocyclic nucleus, and F and F' each independently represents a cyano group, an ester group, an acyl group, a carbamoyl group or an alkylsulfonyl group;

D3

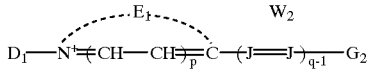

wherein $D_1$, $E_1$, J, p, q and $W_2$ are as defined above for formula D1, and $G_2$ represents a amino group or an aryl group;

D4

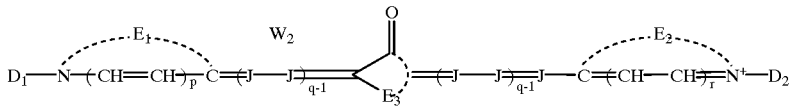

wherein $D_1$, $E_1$, $D_2$, $E_1$, J, p, q, r and $W_2$ are as defined for formula D1 above, and $E_3$ is defined the same as $E_4$ for formula D2 above;

D5

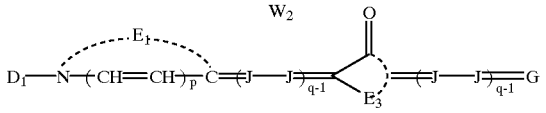

wherein $D_1$, $E_1$, J, G, p, q, r, $W_2$ and $E_3$ are as defined above.

In the above formulas, $E_1$ and $E_2$ each independently represents the atoms necessary to complete a substituted or unsubstituted 5- or 6-membered heterocyclic nucleus. These include a thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula D1 are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-5-dihydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole,, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole,, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1.2-d]

benzotellurazole, 5,6-dimethoxybenzotellurazole, 5-methoxybenzotellurazole, 5-methylbenzotellurazole; a thiazoline nucleus, e.g., thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano group, an ester group such as ethoxy carbonyl, methoxycarbonyl, etc., an acyl group, a carbamoyl group, or an alkylsulfonyl group such as ethylsulfonyl, methylsulfonyl, etc. Examples of useful nuclei for $E_4$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2-,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazoledeione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-a-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-a-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-a-naphthyl-2,4-imidazolidinedione, 1,3-diethyl-2,4-imidazolidinedione, 1-ethyl-3-phenyl-2,4-imidazolidinedione, 1-ethyl-2-a-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

$G_2$ represents a substituted or unsubstituted amino group (e.g., primary amino, anilino), or a substituted or unsubstituted aryl group (e.g., phenyl, naphthyl, dialkylaminophenyl, tolyl, chlorophenyl, nitrophenyl).

According to the formulas D1–D5, each J represents a methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

$W_2$ represents a counterion as necessary to balance the charge of the dye molecule. Such counterions include cations and anions for example sodium, potassium, triethylammonium, tetramethylguanidinium, diisopropylammonium and tetrabutylammonium, chloride, bromide, iodide, paratoluene sulfonate and the like.

$D_1$ and $D_2$ are each independently aryl groups (preferably of 6 to 15 carbon atoms), or more preferably, alkyl groups (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and alkyl groups (preferably a lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc., or an aralkyl group, e.g., benzyl, phenethyl, etc.

Examples of photobleachable sensitizing dyes useful in the invention are:

D-1

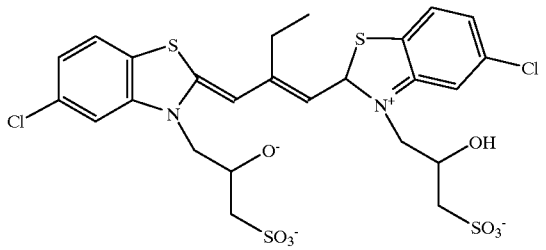

D-2

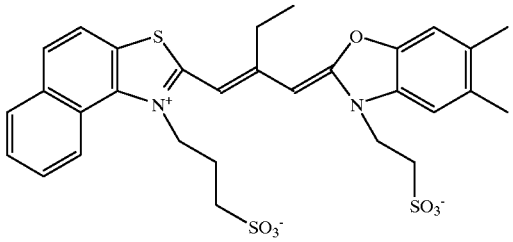

D-3

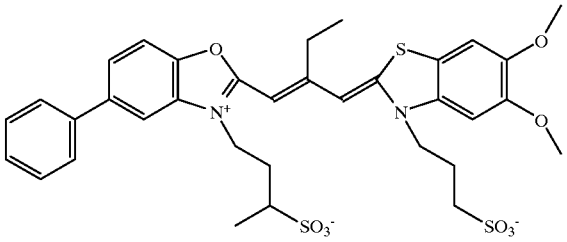

D-4

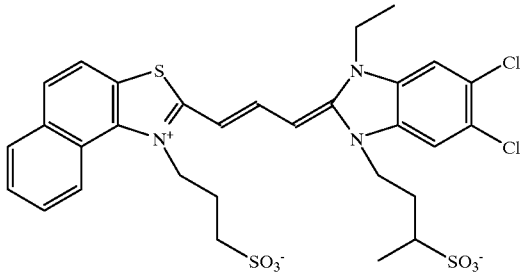

-continued
D-5
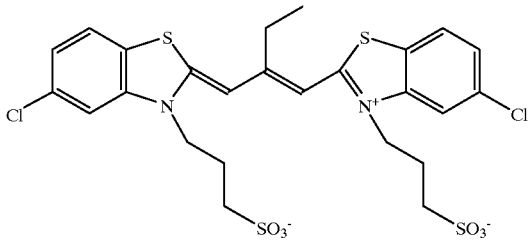
D-6
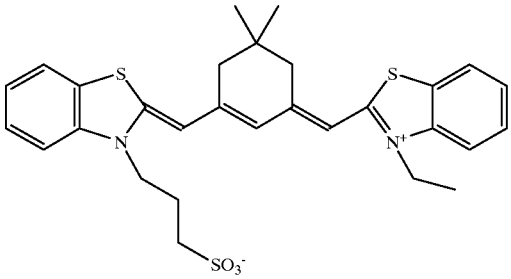
D-7
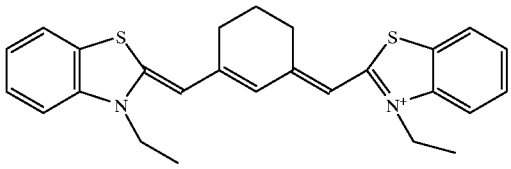
D-8
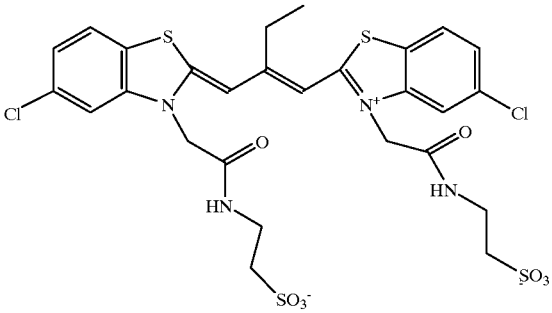
D-9
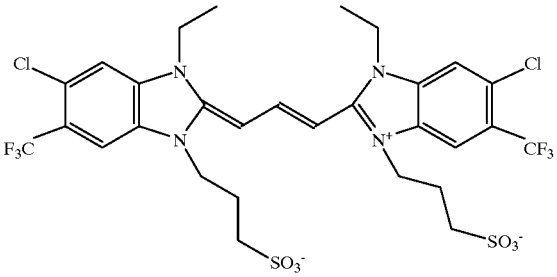
-continued
D-10
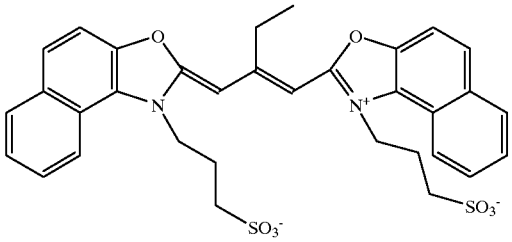
D-11
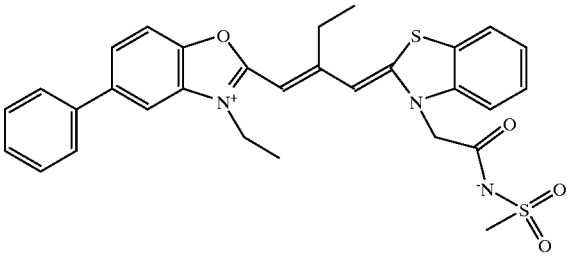
D-12
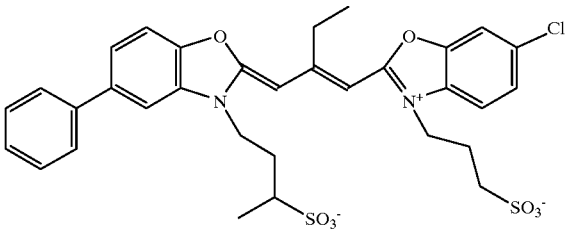
D-13
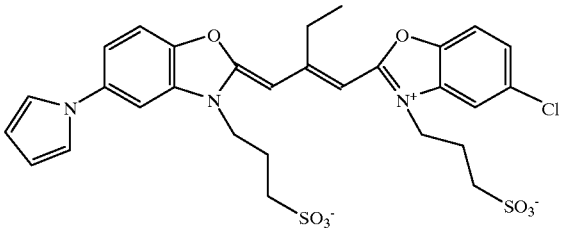
D-14
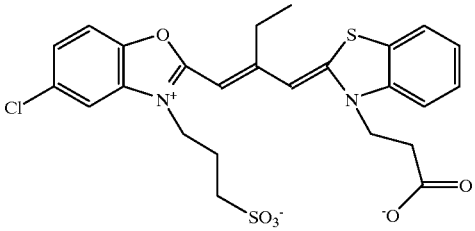

-continued

D-15

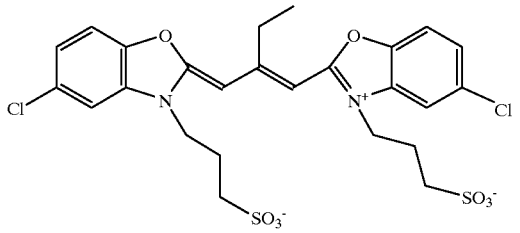

D-16

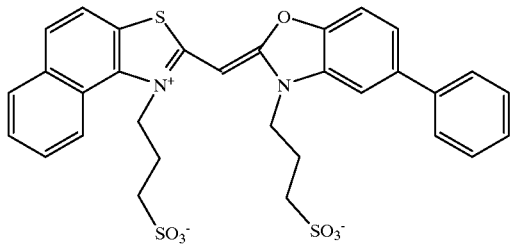

D-17

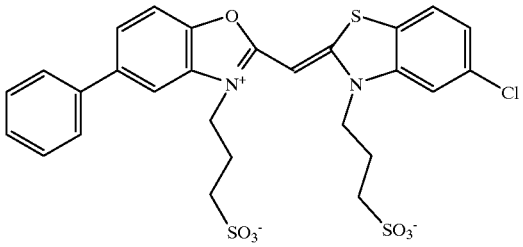

D-18

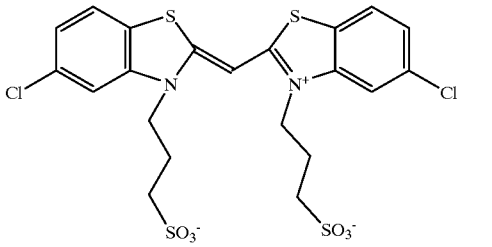

D-19

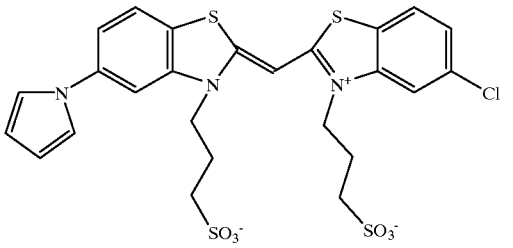

-continued

D-20

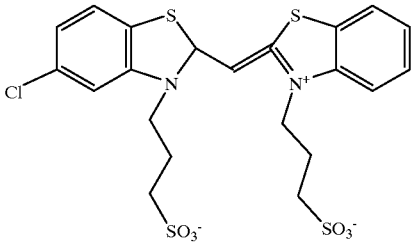

D-21

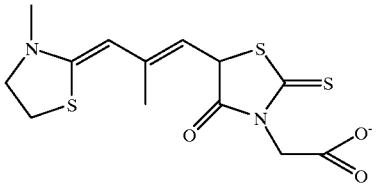

D-22

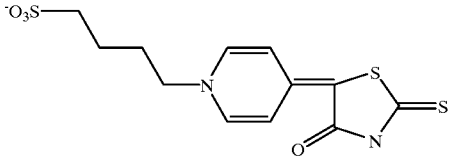

D-23

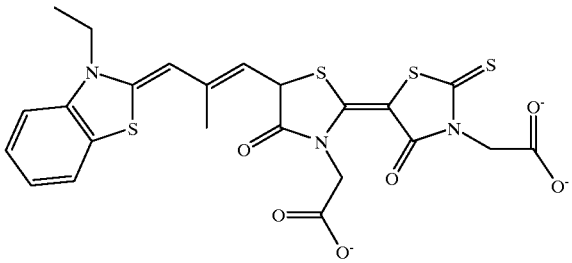

D-24

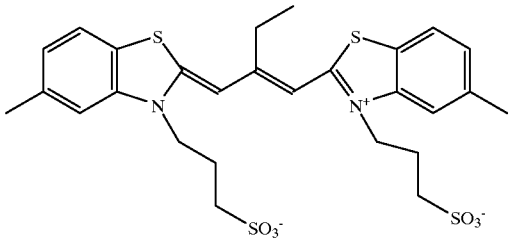

The photographic elements of the present invention can be any known photographic elements such as black and white elements, single color elements or multicolor elements. Conventionally multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support that can be transparent or reflective (for example, a paper support).

Photographic elements can be processed in any of a number of well-known photographic processes utilizing any of a number of well-known processing compositions, described, for example, in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. Preferred color developing agents are p-phenylenediamines. Development is followed by bleach-fixing, to remove silver or silver halide, washing and drying.

According to one embodiment, the element of the invention is a reversal element and comprises a support having thereon in the following order, a red-light sensitive layer having a cyan dye-forming color coupler associated therewith; a green-light sensitive layer having a magenta dye-forming color coupler associated therewith and, and a blue-light sensitive layer having a yellow dye-forming color coupler associated therewith. Color reversal elements are those containing negative-working emulsions and intended to be developed first in a black-and-white developer, which does not form any image dyes, followed by a fogging step, and finally processed in a developer which can form image dyes.

Photographic elements and photographic processing are disclosed in Research Disclosure previously cited.

In the method of the invention, exposition to radiation of the exposed and processed photographic element can be carried out by photoexcitation of the sensitizing dye (i.e., visible to infrared light, depending on the absorption range of the dye) or by photoexcitation of the N-oxyazinium (mostly ultraviolet light). The dye stain reduction is believed to occur as a result of reaction of an alkoxy radical that results from cleavage of the N—O bond of the N-oxyazinium compound as disclosed below.

In the following reaction, the successive reactions are disclosed from a pyridinium compound as N-oxyazinium compound, however it should be understood that the useful compound can be any N-oxyazinium compounds useful in the scope of the invention.

In reactions induced by photoexcitation of a sensitizing dye, it is believed that the excited dye (dye*) transfers an electron to the N-oxyazinium compound to yield an oxidized dye (a dye radical cation, $dye^{\bullet+}$) and a reduced N-oxyazinium compound (the radical, $A^{\bullet}$). The alkoxy radical ($A^{\bullet}$) fragments to give an oxy radical ($^{\bullet}OR_1$) and a nitrogen heterocycle (A). Reaction of the oxy radical with the dye, or more likely with the oxidized dye ($dye^{\bullet+}$), leads to a colorless compound or a less colored compound thus providing a bleached material.

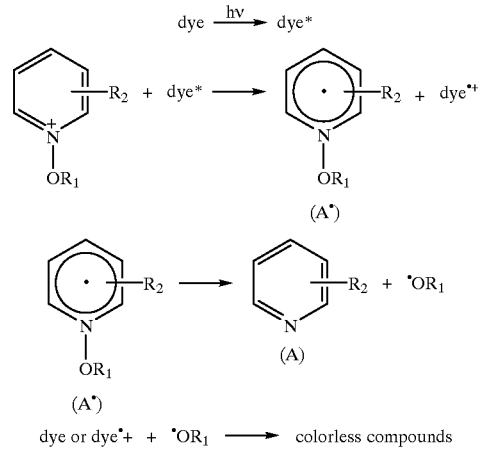

The feasibility of electron transfer from an excited dye to an N-oxyazinium compound depends on the energetics of the reaction. The reaction energetics are determined by the relative reduction potentials of the photobleachable dye and the N-oxyazinium compound. According to a preferred embodiment, the reduction potential of the N-oxyazinium compound is less negative than that of the photobleachable dye. However the reaction will still take place, although with a somewhat smaller rate constant, if the reduction potential of the N-oxyazinium compound is equal to or is slightly (ca. 0.1 V) more negative than that of the dye to be bleached.

For spectral sensitization of silver halide to occur efficiently using a sensitizing dye, the dye has to have a reduction potential which is either equal to or is more negative than ca −0.9 V, vs. SCE (saturated calomel electrode). Thus, in this embodiment, any N-oxyazinium compound with a reduction potential less negative than ca. −1.2 V would react with all sensitizing dyes.

For sensitizing dyes that have reduction potentials more negative than −0.9 V, the range of the reduction potentials of the N-oxyazinium compounds can be extended in accordance with the general requirement mentioned above.

The reduction potential of the N-oxyazinium compounds can be measured by conventional electrochemical techniques. Alternatively, it can be estimated from the reduction potentials of the corresponding N-alkylazinium compounds that are reported in the literature. The compounds listed above have reduction potentials of −0.9 V or less negative.

As mentioned above, to function as sensitizing dyes, these usually have reduction potentials of ca. −0.9 V or more negative. Thus the energetic requirements mentioned above are met for any dye that is capable of sensitizing silver halide.

It is also believed that reactions via excitation of the N-oxyazinium compounds proceed via fragmentation of the N—O bond of the photoexcited N-oxyazinium compound to yield the radical cation of the nitrogen heterocycle ($A^{\bullet+}$) and an oxy radical ($^{\bullet}OR_1$). The radical cation ($A^{\bullet+}$) can abstract an electron from a dye to yield the nitrogen heterocycle (A) and the oxidized dye (a dye radical cation, $dye^{\bullet+}$). Thus, the same intermediates are ultimately formed ($^{\bullet}OR_1$ and $dye^{\bullet+}$) whether the reactions are initiated by dye excitation or by excitation of the N-oxyazinium compounds.

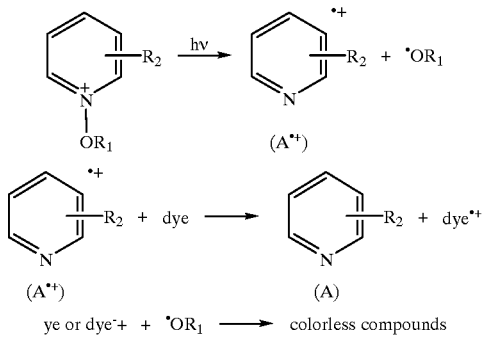

In the other embodiment of the invention, the N-oxyazinium salt can be photochemically excited, where bond cleavage yielding an alkoxy radical and the radical cation of the parent compound as mentioned above. It was found that this excitation mode could also lead to bleaching of the dyes. The energetic requirements mentioned above for reactions initiated by the photoexcited dye do not apply to the reactions initiated by photoexcitation of the N-oxyazinium compound. The latter reactions proceed via N—O bond cleavage of the N-oxyazinium compound. The energetics of this reaction depend on the excitation energy of the N-oxyazinium compound and the N—O bond dissociation energy. N-oxyazinium compounds with first absorption maxima in the UV range or around 400 nm have excitation energies far exceeding the energy required to break the N—O bond.

In the method of the invention, the N-oxyazinium compound can be brought into contact with the photographic material in several ways. The N-oxyazinium compound can be for example incorporated into the photographic element. According to this embodiment, the N-oxyazinium is preferably incorporated in the image-forming layer containing the photobleachable sensitizing dye. In this case the N-oxyazinium compound can be ballasted to alter its solubility and mobility. According to another embodiment, the N-oxyazinium compound is in aqueous solution, the exposed and processed photographic material being contacted with this aqueous N-oxyazinium compound containing solution and then exposed to suitable radiation.

In the method of the present invention, the exposed and processed photographic element is then exposed to radiation. Radiations that can be used are any radiations capable of producing the photobleaching of the dye. Radiations are selected according to the nature of the dye and for the N-oxyazinium compound. The method of the invention can be accomplished by a number of light sources. These include ambient room light from a fluorescent or incandescent lamps, from flash light, mercury or xenon light sources. The UV light may be filtered out by appropriate filters for selective exposure of the residual sensitizing dyes or unfiltered light may be used to excite both the dyes and the N-oxyazinium compounds. Alternatively, mostly UV light sources such as phosphor-coated low-pressure mercury lamps (300 to 350 nm) could be used. The exposure time varies from a few milliseconds when flash lamps are used to several tens of seconds when low intensity light sources are used.

Next, a more detailed description of the invention will be made. However, it is to be understood that the present invention is not limited to the following examples.

EXAMPLES

Example 1

A gelatin coating of the sensitizing dye D-2 on a transparent support was dipped for 60 sec. in a 0.3 wt % solution of N-methoxy-4-phenylpyridinium tosylate in ambient laboratory lights. The wet coating was then exposed to a 10K foot-candle quartz halogen lamp for 20 sec., followed by air drying. As control, the same coating was dipped in distil water, followed by similar light exposure and air-drying. The coating dipped in the bleaching solution showed an optical density of only 0.025 at 559 nm, whereas the control coating had an optical density of 0.209 at 559 nm (λmax. of the dye).

Example 2

Two samples of Kodak Professional Ektachrome E100S® film were used for these experiments. Filtered and neutral step exposures were given to both of these samples and they were processed by E-6 Kodak processing. The red, green, and blue Transmission Status A densities for the 18 steps were measured before and after the dipping experiments.

As control, a sample of the film was dipped into distilled water for 60 seconds and then was exposed to 100 Watt of halogen lamps (1 inch from the source, total residence time for the coating was 60 seconds), washed with water, and was dried overnight. The measured Transmission Status A densities are reported in Table 1. The vast majority of the densities in all three channels remain within +/−0.01 of the pretreatment values.

A second sample of the film was dipped into a freshly made 0.25% solution of N-methoxy-4-phenylpyridinium tosylate in water for 60 seconds and then was exposed to 100 Watt of halogen lamps (1 inch from the source, total residence time for the coating was 60 seconds), washed with water, and was dried overnight. The measured Transmission Status A densities are reported in Table 2.

For almost all the steps, the green densities were reduced by 0.02 unit, whereas for the blue and red the predominant majority of the values reflected the pattern showed by the control group (changes of +/−0.01 unit). This data is very consistent with the removal of the residual green and red sensitizing dyes remaining in the films after processing. The remaining red sensitizing dyes would give rise to green densities as they are present in the monomeric forms. This experiment also shows that the cyan, magenta, and the yellow image dyes present in this film are stable under such bleaching conditions.

TABLE 1

| Neutral Exposures | | | Filtered Exposures | | |
|---|---|---|---|---|---|
| Red* | Green* | Blue* | Red* | Green* | Blue* |
| 2.42/2.45 | 2.61/2.63 | 2.58/2.61 | 0.38/0.37 | 2.02/2.01 | 2.07/2.06 |
| 2.07/2.05 | 2.25/2.24 | 2.13/2.12 | 0.19/0.18 | 0.71/0.70 | 0.70/0.69 |
| 1.74/1.73 | 1.91/1.90 | 1.72/1.71 | 2.00/1.84 | 1.19 | 3.02 |
| 1.43/1.42 | 1.58 | 1.39 | 0.95/0.94 | 0.47/0.46 | 1.69 |
| 1.17 | 1.31/1.30 | 1.12 | 0.28/0.27 | 0.19 | 0.59/0.58 |
| 0.93/0.92 | 1.04 | 0.88/0.87 | 2.73/2.71 | 3.04/3.03 | 0.97/0.96 |
| 0.72 | 0.82/0.81 | 0.67/0.66 | 1.40/1.39 | 1.66/1.65 | 0.46/0.45 |
| 0.56/0.55 | 0.63/0.62 | 0.50/0.49 | 0.46/0.45 | 0.56/0.55 | 0.21 |
| 0.42/0.41 | 0.46/0.45 | 0.37/0.36 | 2.24/2.23 | 1.08/1.07 | 0.56/0.55 |
| 0.30 | 0.32/0.31 | 0.27/0.26 | 1.05 | 0.37/0.36 | 0.21/0.20 |
| 0.22/0.21 | 0.23/0.22 | 0.20/0.19 | 0.32/0.31 | 0.17/0.16 | 0.13/0.12 |
| 0.16 | 0.18/0.17 | 0.15 | 0.74/0.73 | 2.69/2.78 | 0.89 |
| 0.13/0.12 | 0.15/0.14 | 0.13/0.12 | 0.31/0.30 | 1.49/1.48 | 0.40/0.39 |
| 0.11 | 0.14/0.13 | 0.12/0.11 | 0.16/0.15 | 0.47/0.46 | 0.18 |
| 0.11 | 0.13/0.12 | 0.11 | 0.48 | 0.72/0.71 | 2.85/2.89 |
| 0.11/0.10 | 0.13/0.12 | 0.11 | 0.13 | 0.24/0.23 | 1.50 |

TABLE 1-continued

| Neutral Exposures | | | Filtered Exposures | | |
|---|---|---|---|---|---|
| Red* | Green* | Blue* | Red* | Green* | Blue* |
| 0.11/0.10 | 0.13/0.12 | 0.11 | 0.11/0.10 | 0.15 | 0.51/0.52 |
| 0.16/0.10 | 0.19/0.12 | 0.16/0.11 | 0.11/0.10 | 0.13/0.12 | 0.11 |

*before/after treatment (only one entry indicate that the before and after readings were identical)

TABLE 2

| Neutral Exposures | | | Filtered Exposures | | |
|---|---|---|---|---|---|
| Red* | Green* | Blue* | Red* | Green* | Blue* |
| 2.56/2.55 | 2.60/2.58 | 2.70/2.69 | 0.39 | 2.02 | 2.14/2.13 |
| 2.21/2.20 | 2.26/2.24 | 2.23/2.22 | 0.19/0.20 | 0.73/0.72 | 0.71 |
| 1.87/1.85 | 1.91/1.89 | 1.77/1.75 | 2.13/2.11 | 1.21/1.20 | 3.09/3.10 |
| 1.55/1.54 | 1.61/1.58 | 1.42/1.40 | 1.03 | 0.48/0.46 | 1.70/1.69 |
| 1.26 | 1.32/1.30 | 1.12 | 0.31/0.32 | 0.20/0.18 | 0.56 |
| 1.02/1.01 | 1.06/1.04 | 0.89/0.88 | 2.90/2.89 | 3.03/3.01 | 0.98/0.97 |
| 0.80 | 0.83/0.82 | 0.67 | 1.50 | 1.65/1.63 | 0.47 |
| 0.62/0.63 | 0.65/0.63 | 0.51 | 0.52 | 0.56/0.54 | 0.22/0.21 |
| 0.47/0.49 | 0.48/0.47 | 0.37 | 2.38/2.37 | 1.10/1.07 | 0.58/0.57 |
| 0.35/0.36 | 0.35/0.33 | 0.26 | 1.13/1.15 | 0.38/0.36 | 0.22/0.21 |
| 0.25/0.26 | 0.24/0.23 | 0.18 | 0.35/0.37 | 0.18/0.15 | 0.13/0.12 |
| 0.18/0.19 | 0.18/0.16 | 0.14 | 0.78/0.80 | 2.73/2.74 | 0.88/0.89 |
| 0.14/0.15 | 0.15/0.13 | 0.12 | 0.33 | 1.49/1.47 | 0.41/0.40 |
| 0.12/0.13 | 0.14/0.12 | 0.11 | 0.16/0.17 | 0.47/0.45 | 0.18 |
| 0.11/0.12 | 0.13/0.11 | 0.11/0.10 | 0.53/0.54 | 0.73 | 2.94/2.91 |
| 0.11/0.12 | 0.13/0.11 | 0.11/0.10 | 0.135/0.16 | 0.24/0.22 | 1.47 |
| 0.11/0.12 | 0.13/0.11 | 0.11/0.10 | 0.11/0.12 | 0.16/0.13 | 0.52/0.53 |
| 0.11/0.12 | 0.13/0.11 | 0.11/0.10 | 0.11/0.12 | 0.13/0.11 | 0.11/0.10 |

*before/after treatment (only one entry indicate that the before and after readings were identical)

Example 3

Kodak Ektacolor Edge 5 Paper and RA-4 processing without any Blankophor Reu® in the developer was used for this experiment. These dry papers were dipped for 15 sec. in a solution containing 2.5 g/L of N-methoxy-4-phenylpyridinium tosylate under ambient laboratory lights, followed by 10 sec. of 10 K foot-candle intensity light from a tungsten quartz halogen lamp exposure, 20 sec. distil water wash, and air-dried overnight in the dark. As control, a paper sample was subjected to all the similar light exposures, wash and drying, except that it was dipped in distil water free of N-alkoxyazinium for 15 sec.

The reflectance status A densities of the samples were measured. In the Dmin areas the control showed 0.01 higher density in the blue channel, whereas the red and green had identical densities. This is consistent with bleaching of the retained blue sensitizing dye.

TABLE 3

| | Control | Invention |
|---|---|---|
| Visible | 0.12 | 0.12 |
| Red | 0.09 | 0.09 |
| Green | 0.12 | 0.12 |
| Blue | 0.10 | 0.09 |

Example 4

Kodak Ektacolor Edge 5 Paper and RA-4 Kodak processing with 0.25 g/L Blankophor Reu® in the developer was used for this experiment. Blankophor Reu® is known to reduce dye stain. Samples of this dry paper were dipped for 15 sec. in a solution containing 2.5 g/L of N-methoxy-4-phenylpyridinium tosylate under ambient laboratory lights, followed by 10 sec. of 10 K foot-candle intensity light from a tungsten quartz halogen lamp exposure, 20 sec. distil water wash, and air-dried overnight in the dark. As control, a sample of the same paper was subjected to all the similar light exposures, wash and drying, except that it was dipped in distil water free of N-alkoxyazinium for 15 sec.

The reflectance status A densities of the samples were measured at four different areas of the stepped exposure regions. For the vast majority of the areas with neutral and filtered exposures, only the blue densities in the yellow exposure areas and the yellow component of the neutral areas show a 0.01 to 0.02 density reduction in the blue channel. This is consistent with the bleaching of the retained blue sensitizing dye and the image dyes being unaffected by such a treatment.

The data is tabulated in table 4 below:

TABLE 4

| | Neutral exposure area | | Cyan Exposure area | | Magenta exposure area | | Yellow exposure area | |
|---|---|---|---|---|---|---|---|---|
| | Cont. | Inv. | Cont. | Inv. | Cont. | Inv. | Cont. | Inv. |
| Visible | 0.95 | 0.96 | 0.73 | 0.72 | 0.23 | 0.23 | 0.21 | 0.21 |
| Red | 1.05 | 1.06 | 1.26 | 1.25 | 0.10 | 0.10 | 0.12 | 0.12 |
| Green | 0.99 | 1.01 | 0.46 | 0.47 | 0.35 | 0.35 | 0.33 | 0.34 |
| Blue | 0.94 | 0.94 | 0.32 | 0.32 | 0.15 | 0.15 | 1.15 | 1.14 |
| Visible | 1.26 | 1.26 | 0.87 | 0.87 | 0.31 | 0.31 | 0.24 | 0.24 |
| Red | 1.40 | 1.40 | 1.61 | 1.61 | 0.12 | 0.12 | 0.13 | 0.13 |
| Green | 1.34 | 1.35 | 0.56 | 0.56 | 0.52 | 0.52 | 0.39 | 0.39 |
| Blue | 1.26 | 1.25 | 0.38 | 0.38 | 0.20 | 0.20 | 1.41 | 1.39 |
| Visible | 1.59 | 1.59 | 1.00 | 0.99 | 0.42 | 0.42 | 0.26 | 0.26 |
| Red | 1.77 | 1.77 | 1.92 | 1.92 | 0.15 | 0.16 | 0.14 | 0.14 |
| Green | 1.71 | 1.72 | 0.65 | 0.65 | 0.74 | 0.75 | 0.43 | 0.43 |
| Blue | 1.59 | 1.58 | 0.43 | 0.43 | 0.27 | 0.27 | 1.60 | 1.58 |
| Visible | 2.52 | 2.53 | 1.28 | 1.30 | 0.87 | 0.87 | 0.37 | 0.37 |
| Red | 2.71 | 2.71 | 2.51 | 2.57 | 0.35 | 0.35 | 0.18 | 0.18 |
| Green | 2.72 | 2.71 | 0.89 | 0.91 | 2.19 | 2.19 | 0.65 | 0.64 |
| Blue | 2.46 | 2.45 | 0.56 | 0.56 | 0.68 | 0.67 | 2.01 | 1.98 |

Example 4

Kodak Professional Ektachrome E100S® Film samples were processed using E-6 process with prebleach II wherein the final rinse bath contained 1 g/L of the N-methoxy-4-phenylpyridinium tosylate. A time series of 0, 15, 30, 45, 60, 90, 120, and 180 seconds residence times in this final rinse bath under ambient laboratory lights were carried out. The Dmin. areas of the 2 stops overexposed films were analyzed spectrophotometrically for residual sensitizing dye stains. The optical densities of the two sensitizing peaks decreased gradually as the residence time in the final rinse increased. The optical density at 508 nm dropped from 0.158 to 0.128. The optical density at 575 nm dropped from 0.163 to 0.142. The image dye densities of the samples were unchanged.

Example 5

Kodak Ektacolor Edge 5 Paper and RA-4 Kodak processing without any Blankophor Reu® in the developer was used for this experiment. Samples of this dry paper containing D-19 were dipped in 0.5 wt % of N-methoxy-4-phenylpyridinium tosylate solutions in the ambient laboratory lights or in the dark room for 20 sec., followed by 60 sec. of ambient light exposure (the sample which was dipped in the dark was kept also in the dark for this time period), 20 sec. distil water wash (the sample which was dipped in the dark was kept also in the dark for this time period), and air dried in the dark. A control example was carried out by dipping a paper sample in distil water. All the samples dipped in the N-methoxy-4-phenylpyridinium tosylate solution had less yellow stain as evidenced by the drop in the reflectance density of the broad peak between 470 to 520 nm. The image dye density of the samples was unchanged.

Example 6

Kodak Professional Ektachrome E100S® Film samples were processed using E-6 Kodak® process. These films were dipped into 6 mM solutions containing N-methoxy-4-phenylpyridinium tosylate (invention), N-methoxy-3-phenylpyridinium tosylate (invention), and N-ethyl-4-phenylpyridinium tosylate (comparative example) for 5 minutes at ambient laboratory lights, followed by air-drying in the dark. The Dmin. areas of the 2 stops overexposed films were analyzed spectrophotometrically for residual sensitizing dye stains.

The optical densities for the film dipped in solution containing the comparative compound N-ethyl-4-phenylpyridinium tosylate were 0.140 and 0.155 at 508 nm and 575 nm, respectively. The optical densities for the films dipped in N-methoxy-4-phenylpyridinium tosylate solution were 0.095 and 0.118 at 508 nm and 575 nm, respectively. The optical densities for the films dipped in N-methoxy-3-phenylpyridinium tosylate solution were 0.108 and 0.128 at 508 nm and 575 nm, respectively. These improvements are consistent with the bleaching of the retained red and green sensitizers with the compounds of this invention, whereas the N-ethyl analog is unable to reduce the sensitizing dye stain.

Example 7

In these experiments, solutions containing N-methoxy-4-phenylpyridinium tosylate and various classes of dyes were conducted in order to monitor the photo-bleaching efficiencies.

A methanolic solution of a dye indicated below (1.5 ml) was added to a methanolic solution of N-methoxy-4-phenylpyridinium tosylate (3.5 ml of 56 mMolar solution) in a clear glass vial. The concentration of the dye solution was such that the resulting mixture had an optical density of approximately 1.0 at the $\lambda_{max.}$ of the dye. The resulting mixture was shaken to allow complete mixing. The vial was placed on top of a regular Light Table (normal 40 Watt Cool White fluorescent lamp illumination) for 15 minutes.

A vial containing the same dye solution and the appropriate amount of methanol without any reagent was subjected to the same Light Table exposure. This was used as the control. Absorption spectrum was run for the experimental solution and the control.

The percent bleaching was calculated by comparing the optical densities of the experimental solution and the control at the $\lambda_{max.}$ of the dye.

Table 5 contains the solution photo-bleaching data for the sensitizing dyes.

TABLE 5

Photo-bleaching Data for spectral Sensitizing Dyes

| Red Sensitizing Dyes | | Green Sensitizing Dyes | | Blue Sensitizing Dyes | | Merocyanine Sensitizing Dyes | |
|---|---|---|---|---|---|---|---|
| Dye ID | % Bleach. | Dye ID | % Bleach | Dye ID | % Bleach | Dye ID | % Bleach |
| D-1 | 93 | D-9 | 97 | D-16 | 72 | D-21 | 66 |
| D-2 | 100 | D-10 | 93 | D-17 | 64 | D-22 | 45 |
| D-3 | 94 | D-11 | 83 | D-18 | 83 | D-23 | 100 |
| D-4 | 100 | D-12 | 93 | D-19 | 76 | | |
| D-5 | 92 | D-13 | 95 | D-20 | 86 | | |

TABLE 5-continued

Photo-bleaching Data for spectral Sensitizing Dyes

| Red Sensitizing Dyes | | Green Sensitizing Dyes | | Blue Sensitizing Dyes | | Merocyanine Sensitizing Dyes | |
|---|---|---|---|---|---|---|---|
| Dye ID | % Bleach. | Dye ID | % Bleach | Dye ID | % Bleach | Dye ID | % Bleach |
| D-6 | 96 | D-14 | 65 | | | | |
| D-7 | 50 | D-15 | 92 | | | | |
| D-8 | 99 | | | | | | |
| D-24 | 98 | | | | | | |

This data shows that a large variety of spectral sensitizing dyes can be photobleached with a photobleaching solution containing N-methoxy-4-phenyl pyridinium.

Example 8

In these experiments, solutions containing as N-oxyazinium, the compounds listed in table 6 below and the sensitizing dye D-1 were conducted in order to monitor the photo-bleaching efficiencies under similar conditions of example 7.

The photo-bleaching data of each of the solutions are given in Table 6.

The solution photo-bleaching data are given in Table 6.

TABLE 6

Photo-bleaching Data for various N-oxyazinium compounds

| N-oxyazinium | % Bleachings | N-oxyazinium | % Bleachings |
|---|---|---|---|
| A-1 | 100 | A-17 | 95 |
| A-2 | 99 | A-18 | 97 |
| A-3 | 98 | A-19 | 27 |
| A-10 | 100 | A-20 | 40 |
| A-12 | 95 | A-21 | 30 |
| A-13 | 100 | A-22 | 64 |
| A-15 | 75 | A-23 | 14 |
| A-16 | 100 | A-24 | 52 |

Example 9

A green sensitizing dye D-15 was coated with ten equivalents of N-methoxy-4-phenylpyridinium tosylate with gelatin. The dry coating was exposed 25 min. to 10 K foot-candles of intensity of light from tungsten quartz halogen lamp through a 2E Wratten Filter (no transmission below 410 nm). The optical density at the λmax. (508 nm) dropped by 90% (from 0.10 to 0.01) when compared to the control wherein the coating was free of alkoxypyridinium but exposed to the same light source.

When these coatings were even slightly dampened with small amount of water, the photo-bleaching efficiencies increase very significantly (at least 100 times faster bleaching were noticed). This slow efficiency in photo-bleaching the sensitizing dyes in dry coatings results from the need for the excited dye and photo-bleach reagents to be in very close proximity in order for the photo-bleaching to be successful. When mobility is imparted to either the dye or the reagent—for example with the dampened coatings the photobleaching is very efficient.

The invention has been described in detail with particular reference to certain preferred embodiments thereof, but it will be understood that variations and modifications can be effected within the spirit and scope of the invention.

What is claimed is:

1. A method for reducing dye stain of an exposed photographic element, said element comprising a support having thereon at least one image-forming layer containing a photobleachable dye, the method comprising processing the element, and exposing the processed element, in presence of a N-oxyazinium, to radiation that can be absorbed either by the photobleachable dye or by the N-oxyazinium.

2. The method of claim 1 wherein the N-oxyazinium compound has a reduction potential less negative than −1.2 V, and comprises an N-oxy group capable of releasing an oxy group that reacts with the photobleachable dye to give a bleached compound.

3. The method of claim 1 wherein the N-oxyazinium has one of the following formulae:

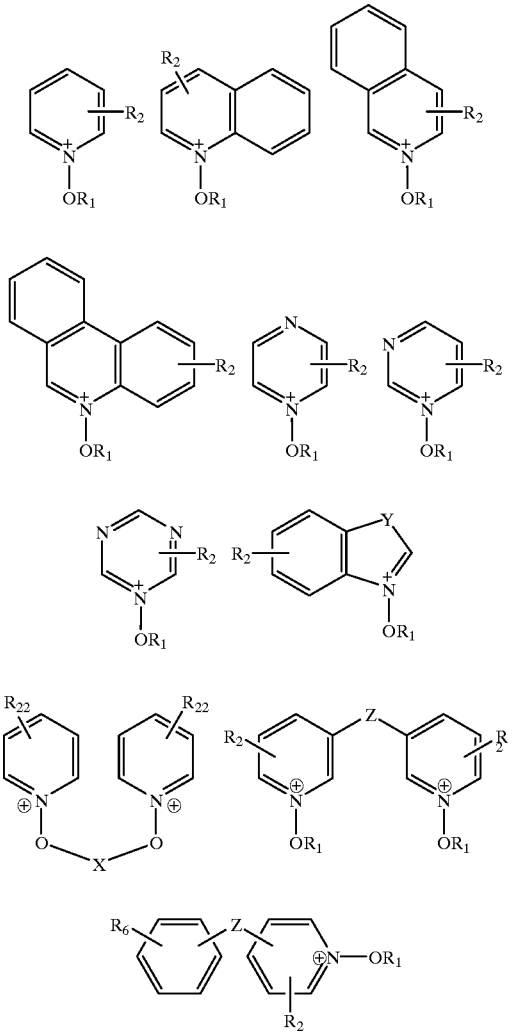

wherein $R_1$ represents alkyl group of 1–12 carbons, or alkyl group substituted with one or more groups selected from the group consisting of acyloxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, carboxy, sulfo, trihalomethyl, alkyl, aryl, heteroaryl, alkylureido, arylureido, succinimido, and phthalimido substituent; aryl group, or acyl group; $R_2$, $R_{22}$ or $R_6$ represents independently hydrogen, an alkyl group of 1–12 carbons, an aryl or heteroaryl group, unsubstituted or substituted with one or more substituents selected from the group consisting of an acyloxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, carboxy, sulfo, trihalomethyl, alkyl, aryl, heteroaryl, alkylureido, arylureido, succinimido and phthalimido substituent, or an acyloxy, hydroxy, alkoxy, aryloxy, alkylthio, arylthio, alkylsulfonyl, thiocyano, cyano, halogen, alkoxycarbonyl, aryloxycarbonyl, acetyl, aroyl, alkylaminocarbonyl, arylaminicarbonyl, alkylaminocarbonyloxy, arylaminocarbonyloxy, acylamino, amino, alkylamino, arylamino, carboxy, sulfo, trihalomethyl, alkyl, aryl, heteroaryl, alkylureido, arylureido, succinimido, phthalimido group, —CO—$R_3$ wherein $R_3$ is an alkyl or an aryl group, or —(CH═CH)$_m$—$R_4$ wherein $R_4$ is an aryl or heterocyclic group ; m is 1 or 2; Y is selected from the group consisting of S, O, Se, —C($R_1$)$_2$, and —N$R_1$; X is a divalent linking group selected from a group consisting of substituted or unsubstituted methylenes, (—C$R_5R_7$—)$_n$ and [(—C$R_5R_7$)$_n$X$_1$—(C$R_5R_7$—)$_P$] wherein $R_5$ or $R_7$ are independently hydrogen, alkyl, substituted alkyl, aryl, substituted aryl, heteroaryl, substituted heteroaryl group, n and p are from 1–12, $X_1$ is aryl or heteroaryl nuclei, carbonyl, sulfo, thio, oxy; and Z is an alkylidene group.

4. The method of claim 1 wherein the N-oxyazinium compound is an N-alkyoxylazinium compound.

5. The method of claim 4 wherein the N-oxyazinium compound is represented by one of the following formulae:

(II)

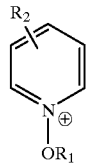

(III)

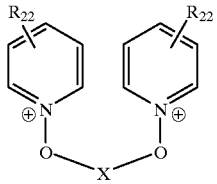

wherein $R_1$ is an alkyl, an aryl or an acyl, $R_2$ or $R_{22}$ are independently an hydrogen atom, alkyl, aryl, heterocyclic, carboxylic, carboxylate, carbonamido, sulfonamido, nitryl, groups, —CO—$R_3$ wherein $R_3$ is an alkyl group or aryl group, or —(CH═CH)$_m$—$R_4$ group wherein $R_4$ is an aryl or heterocyclic group; X is an alkylene group.

6. The method of claim 1 wherein the N-oxyazinium compound is one of the following compounds:

| | 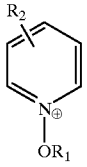 (II) $R_2$ or $R_{22}$ | 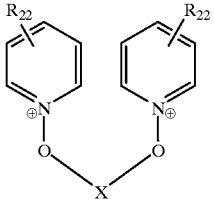 (III) $R_1$ or X |
|---|---|---|
| A-1 | $R_2$ = 4-Ph | $R_1$ = Me |
| A-2 | $R_2$ = 4-Ph | $R_1$ = $(CH_2)_3$—Ph |
| A-3 | $R_2$ = 4-Ph | $R_1$ = $(CH_2)_3$—$SO_3^-$ |
| A-4 | $R_2$ = 4-Ph | $R_1$ = 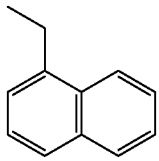 |
| A-5 | $R_2$ = 4-Ph | $R_1$ = 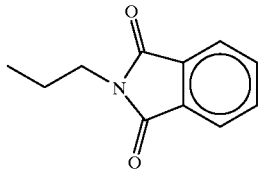 |
| A-6 | $R_2$ = 4-CN | $R_1$ = Me |
| A-7 | $R_2$ = 3-$CO_2$Me | $R_1$ = Me |
| A-8 | $R_2$ = 3-$CO_2$—$(CH_2)_2$—Ph | $R_1$ = Me |
| A-9 | $R_{22}$ = 4-Ph | X = $(CH_2)_3$ |
| A-10 | $R_{22}$ = 4-Ph | X = $(CH_2)_4$ |
| A-11 | $R_{22}$ = 4-Ph | X = $(CH_2)_5$ |
| A-12 | $R_2$ = 3-Ph | $R_1$ = Me |
| A-13 | $R_2$ = 3,4-benzo | $R_1$ = Me |
| A-14 | $R_{22}$ = 3,4-benzo | X = $(CH_2)_3$ |
| A-15 | $R_2$ = H | $R_1$ = $(CH_2)_3$—$SO_3^-$ |
| A-16 | $R_2$ = H | $R_1$ = 4-nitrophenyl |
| A-17 | $R_{22}$ = H | X = $(CH_2)_2$ |
| A-18 | $R_{22}$ = H | X = $(CH_2)_3$ |
| A-19 | $R_2$ = 2-Me | $R_1$ = Me |
| A-20 | $R_2$ = 2-Me | $R_1$ = $(CH_2)_3$—$SO_3^-$ |
| A-21 | $R_2$ = 4-Me | $R_1$ = Me |
| A-22 | $R_{22}$ = 4-Me | X = $(CH_2)_4$ |
| A-23 | $R_2$ = 4-$CO_2^-$ | $R_1$ = Me |
| A-24 | $R_2$ = 4-$CON(CH_2CH_2OH)_2$ | $R_1$ = $(CH_2)_3$—$SO_3^-$ |

7. The method of claim 1 wherein the photobleachable dye is a sensitizing dye.

8. The method of claim 1 wherein the element is contacted with a solution containing the N-oxyazinium compound.

9. The method of claim 1 wherein the N-oxyazinium compound is incorporated in the photographic element.

10. The method of claim 6 wherein the N-oxyazinium is incorporated in the image-forming layer comprising the photobleachable sensitizing dye.

* * * * *